US012599822B2

(12) United States Patent
Jessing

(10) Patent No.: US 12,599,822 B2
(45) Date of Patent: Apr. 14, 2026

(54) NET HOLDER FOR A PLAY NET

(71) Applicant: Sponeta GmbH, Schlotheim (DE)

(72) Inventor: Hannes Paul Jessing, Bad Langensalza (DE)

(73) Assignee: Sponeta GmbH, Schlotheim (DE)

( * ) Notice: Subject to any disclaimer, the term of this patent is extended or adjusted under 35 U.S.C. 154(b) by 798 days.

(21) Appl. No.: 18/063,057

(22) Filed: Dec. 7, 2022

(65) Prior Publication Data

US 2023/0181985 A1 Jun. 15, 2023

(30) Foreign Application Priority Data

Dec. 9, 2021 (DE) ..... 102021132492.0

(51) Int. Cl.
*A63B 67/04* (2006.01)

(52) U.S. Cl.
CPC ..... *A63B 67/045* (2013.01)

(58) Field of Classification Search
CPC ... A63B 67/045; A63B 61/02; A63B 2102/16; A63B 2225/093
See application file for complete search history.

(56) References Cited

U.S. PATENT DOCUMENTS

2021/0339104 A1 11/2021 Havard et al.

FOREIGN PATENT DOCUMENTS

| | | | |
|---|---|---|---|
| CN | 206138683 U | | 5/2017 |
| CN | 216755336 U | | 6/2022 |
| DE | 1786733 | * | 2/1959 |
| DE | 6917462 U | | 8/1969 |
| DE | 7703917 U1 | | 5/1970 |
| DE | 7017776 U | | 8/1970 |
| GB | 1422511 A | | 1/1976 |
| KR | 101709011 B1 | | 2/2017 |

OTHER PUBLICATIONS

Google Translation of DE1786733U. (Year: 1959).*
Germany Office Action, mailing date Oct. 7, 2022 for corresponding German Application No. DE 10 2021 132 492.0 with English translation (12 pages).
European Search Report, dated May 9, 2023 for corresponding European Application No. 22208016.0 with English translation (10 pages).

* cited by examiner

*Primary Examiner* — Jeffrey S Vanderveen
(74) *Attorney, Agent, or Firm* — INTELLECTUAL PROPERTY LAW GROUP LLP

(57) ABSTRACT

The invention relates to a net holder (1) for a play net (23), comprising: an inner post (3) with a net mounting portion (19) designed for insertion into a net loop (24) of the play net (23), and a spindle (12) with an external thread; an at least substantially L-shaped body (2) with an outer post (5) and a cross bar (6), the outer post (5) being designed as a hollow box profile for receiving and guiding the inner post (3) and having a slot-shaped net passage (7), the cross bar (6) having at a free end a fastener for fastening to a playing table; and an adjuster (4) formed as a sleeve having an internal thread configured for engagement with the external thread of the spindle (12), wherein a retainer is provided for retaining the adjuster (4) with respect to a longitudinal position relative to the outer post (5) but allowing rotation of the adjuster (4); wherein at least one of the inner post (3) and the outer post (5) comprises a limiter for limiting a rotation of the inner post (3) in the outer post (5), which however allows a longitudinal displacement.

11 Claims, 7 Drawing Sheets

NET HOLDER FOR A PLAY NET

CROSS-REFERENCE TO RELATED APPLICATION

This application claims priority to German application no. 10 2021 132 492.0 filed on Dec. 9, 2021, which is hereby incorporated by reference in its entirety.

FIELD OF INVENTION

The invention relates to a net holder for a play net, e.g. a table tennis net. Moreover, the invention relates to a net set.

BACKGROUND

DE 6917462 U describes a clamp holder for a table tennis net, comprising a screw clamp, a support leg seated thereon, which on the upper side bears a guide slot for the table tennis net, and a column which is adjustable in height by means of a screw-spindle-like adjusting device and which is held in an attachment of the support leg and comprises a suspension device for the table tennis net, wherein the adjusting device comprises an adjusting nut inserted into a slot of the attachment and a threaded rod which is aligned in the longitudinal direction of the column and which is non-rotatably but longitudinally displaceably guided with respect to the attachment.

SUMMARY

The object of the invention is to provide a novel net holder for a play net and a novel net set.

According to the invention, the object is achieved by a net holder and by a net set having the features of the appended claims.

Advantageous embodiments are subject of the dependent claims.

A net holder for a play net according to the invention comprises:

- an inner post having a net mounting portion configured for insertion into a net loop of the play net, and a spindle having an external thread,
- an at least substantially L-shaped body having an outer post and a cross bar, the outer post being formed as a hollow box profile for receiving and guiding the inner post and having a slot-shaped net passage, the cross bar having a fastener at a free end for fastening to a playing table, and
- an adjuster formed as a sleeve having an internal thread configured to engage the external thread of the spindle, wherein a retainer is provided for retaining the adjuster with respect to a longitudinal position relative to the outer post but allowing rotation of the adjuster, said inner post and/or said outer post having a limiter for limiting rotation of said inner post in said outer post, but allowing longitudinal displacement.

In an embodiment, the cross bar is formed integrally with the outer post.

In an embodiment, the retainer includes a circumferential groove in an outer surface of the adjuster and a projection disposed in the body configured to engage the groove.

In an embodiment, the limiter comprises complementary non-circular cross-sections of the outer post and the inner post. Alternatively or additionally, the limiter comprises at least one tongue extending on the inner post in the longitudinal direction thereof and configured to engage over a net loop disposed on the net mounting portion.

In an embodiment, the adjuster has a length such that it protrudes from the body when the retainer is engaged.

In an embodiment, the adjuster is coaxially fixed to the spindle by engaging the spindle with the threads of the adjuster in the outer post, thereby preventing the groove from disengaging from the projection in a radial direction.

In an embodiment, the inner post has a slot-shaped guide for a tensioning cord of the play net at its end remote from the spindle.

In an embodiment, a fork is provided on a rear side of the outer post opposite the net passage to allow a ball chain attached to the tensioning cord to be hooked thereto.

In accordance with one aspect of the present invention, there is disclosed a net set comprising one or two net holders as described above and a play net provided at one or two ends with a net loop configured to wrap around the net mounting portion, wherein the net passage is configured to pass the play net therethrough.

In one embodiment, the play net includes a tensioning cord having two ends, at least one of which is connected to a ball chain configured to be hooked to the fork.

BRIEF DESCRIPTION OF THE DRAWINGS

Embodiments of the invention will be explained in more detail below with reference to drawings.

DETAILED DESCRIPTION OF SPECIFIC EMBODIMENTS

Figure 1:
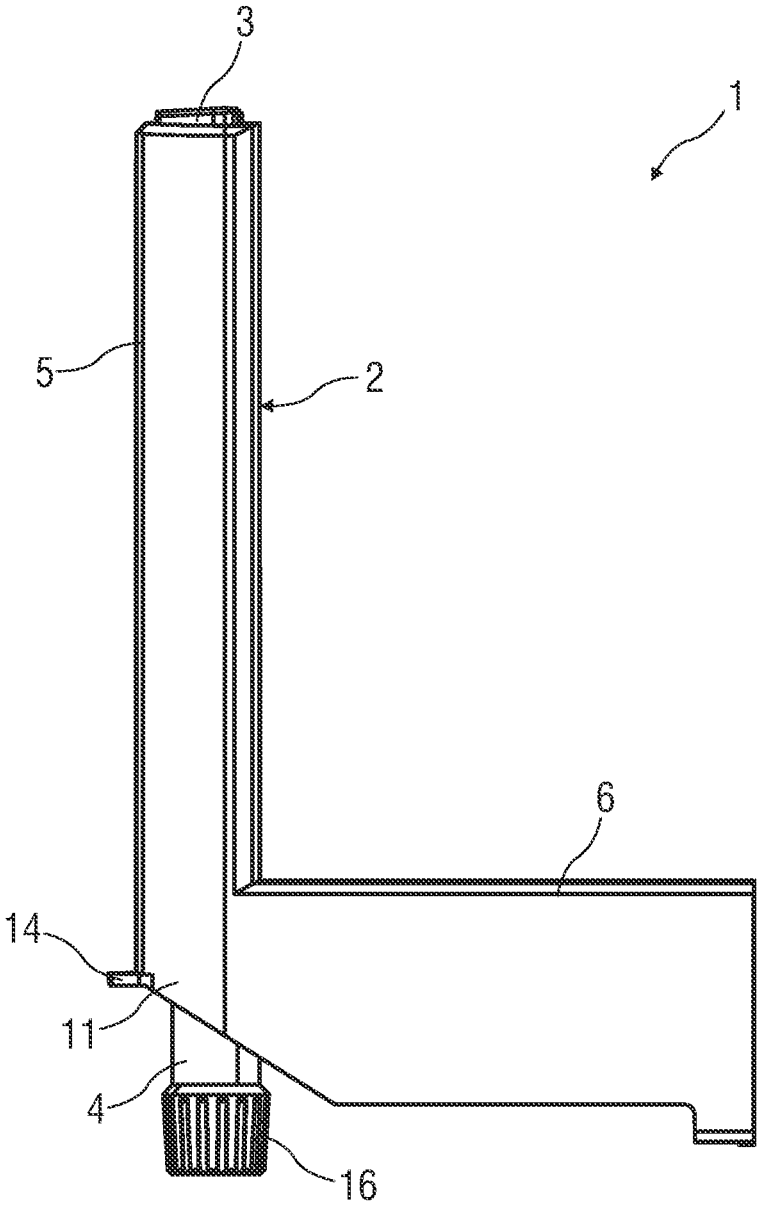
FIG. 1 is a schematic view of a net holder for a play net.
Figure 2:
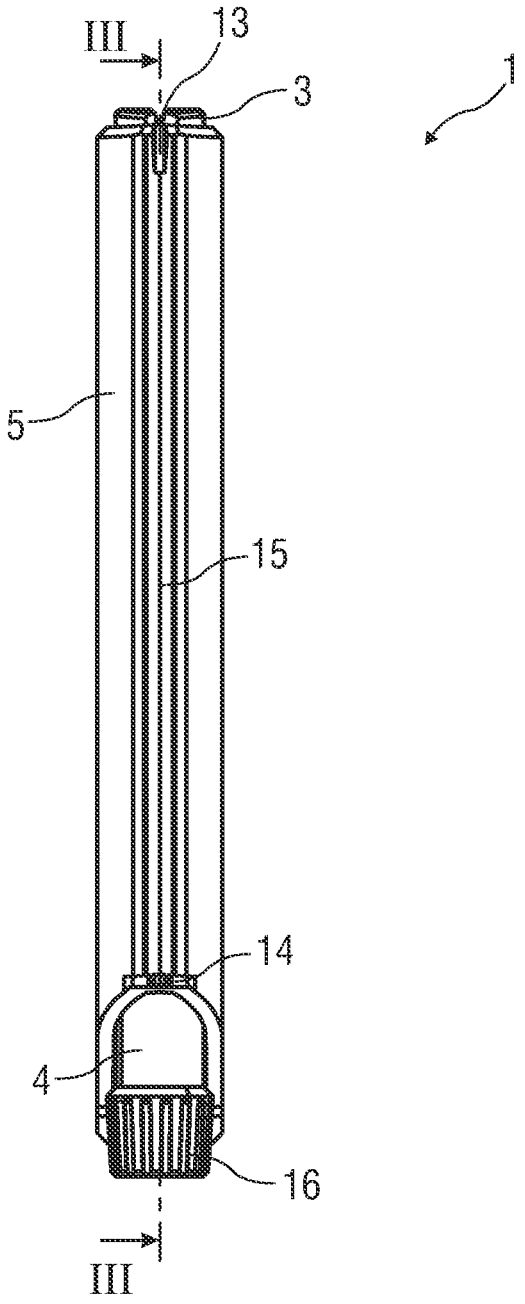
FIG. 2 is a further schematic view of the net holder.
Figure 3:
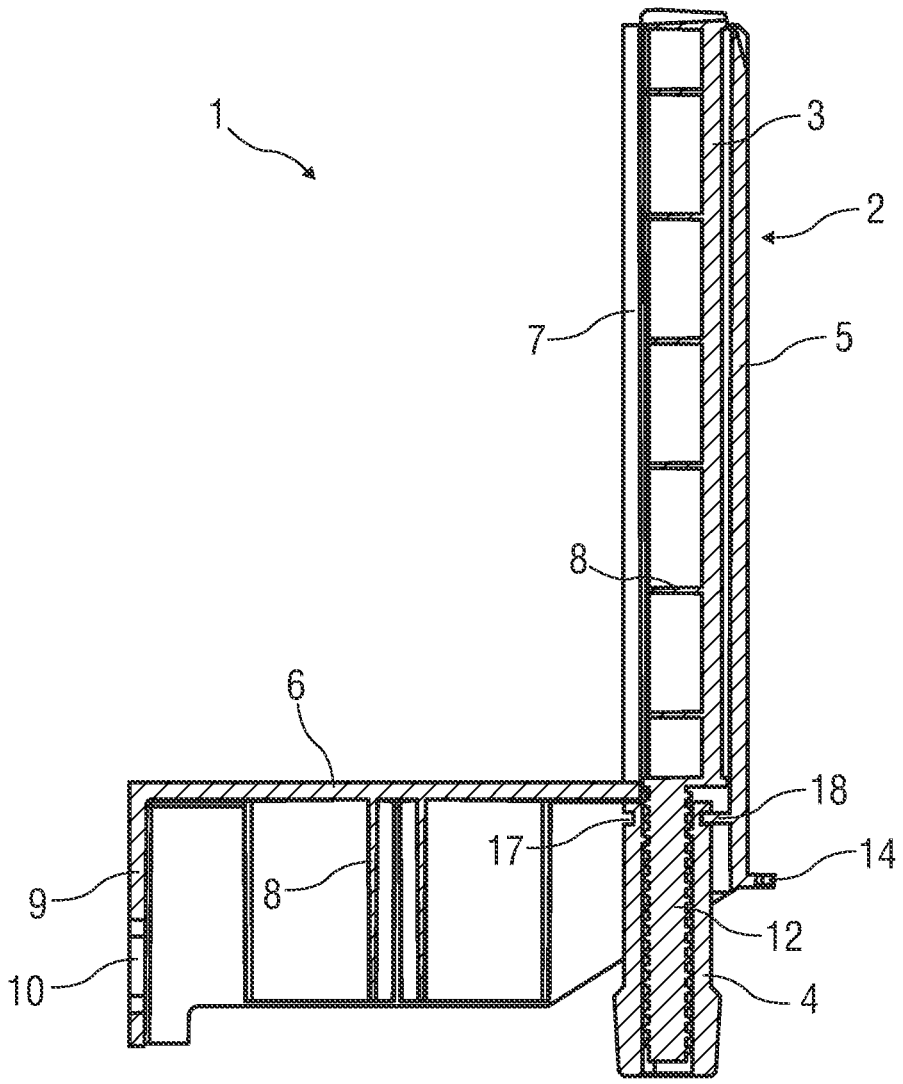
FIG. 3 is a further schematic view of the net holder.
Figure 4:
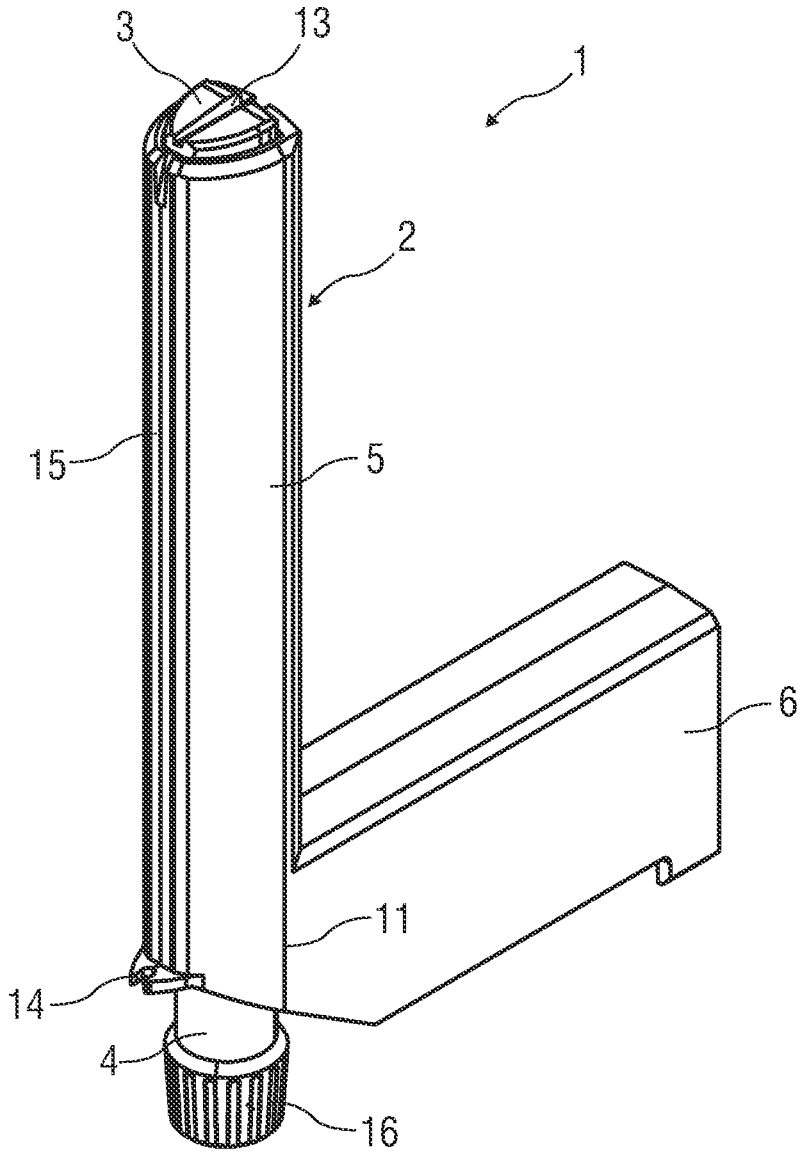
FIG. 4 is a further schematic view of the net holder.

Corresponding parts are given the same reference signs in all figures.

In the context of the present description, directional designations such as up, down, vertical and horizontal refer to a position of use shown in the figures, unless otherwise indicated.

FIGS. 1 to 4 show schematic views of a net holder 1 for a play net 23, for example a table tennis net. The net holder 1 comprises a body 2, an inner post 3 and an adjuster 4.

The body 2, the inner post 3 and the adjuster 4 may be made by means of injection molding, for example of plastic. In particular, the net holder 1 may be formed exclusively from injection molded parts, in particular from plastic.

The at least substantially L-shaped body 2 comprises an outer post 5, which is oriented vertically or substantially vertically in a position of use shown in the figures. Further, the body 2 comprises a cross bar 6 connected to a lower end of the outer post 5, the cross bar 6 forming an angle of about 90° with the outer post 5, for example, and therefore being oriented horizontally or substantially horizontally in the position of use.

The outer post 5 is formed as a hollow box profile with open ends and a slot-shaped net passage 7 extending in a longitudinal direction of the outer post 5, i.e. vertically, and pointing for example in the same direction as the cross bar 6. The hollow box profile of the outer post 5 is, apart from the net passage 7 and the ends, in particular closed. Inside the outer post 5, one or more stiffening ribs 8 may be provided, which may run transversely to the longitudinal direction of the outer post 5, for example.

The cross bar 6 is also formed as a hollow box profile which may be open downwardly, that is, facing away from the outer post 5. An end of the cross bar 6 remote from the outer post 5 has a wall 9 parallel or substantially parallel to the outer post 5, which is pierced by at least one attachment opening 10. This allows the net holder 1 to be attached to a playing table, for example a table tennis table, for example by means of a screw passed through the attachment opening 10. The attachment opening 10 may, for example, be formed as an elongated hole whose longitudinal axis may be parallel or substantially parallel to the outer post 5. In one embodiment, the elongated hole may extend to the lower end of the wall 9, i.e. be open at the bottom.

Inside the cross bar 6, one or more stiffening ribs 8 may be provided, for example extending transversely to the longitudinal direction of the cross bar 6 or arranged in some other way.

A connecting region 11 opposite the wall 9, in which the outer post 5 and the cross bar 6 are connected to each other, may be formed to be inclined outwardly rather than at right angles.

The outer post 5 is designed to receive the inner post 3. For this purpose, the hollow box profile of the outer post 5 has, for example, a non-circular cross-section to prevent the inner post 3 from twisting in the outer post 5. For example, the cross-section of the hollow box profile of the outer post 5 is flattened towards the net passage 7 and is otherwise curved.

In particular, the body 2 is formed in one piece.

Figure 5:
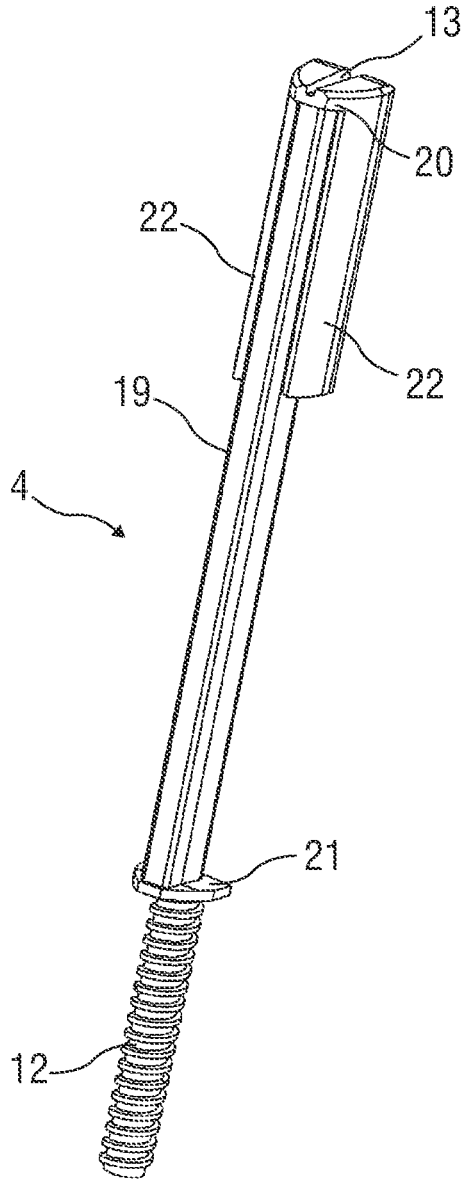
FIG. 5 is a schematic view of an inner post of the net holder.

FIG. 5 is a schematic view of the inner post 3.

The inner post 3 has a net mounting portion 19, the cross-sectional shape of which has a clearance to the cross-sectional shape of the hollow box profile of the outer post 5, in order to allow a net loop 24 of a play net 23 to be wrapped around the net mounting portion 19 when the play net 23 is guided through the net passage 7. The net mounting portion 19 is terminated at the bottom and top respectively by a guide region 20, 21 having a shape substantially complementary to the cross-section of the hollow box section of the outer post 5, optionally with some play. On the upper guide region 20, one or two tongues 22 may be arranged pointing in the direction of the lower guide region 21, for example in such a way that the shape substantially complementary to the cross-section of the hollow box profile of the outer post 5 is at least partially continued by the tongues 22 downwardly, that is, toward the lower guide region 21. The tongues 22 are thereby, for example, between 4.5 cm and 6.5 cm long, in particular about 5.5 cm. Between each tongue 22 and the net mounting portion 19 there remains a gap large enough for the net loop 24 to pass through, for example a minimum of 1 mm to 3 mm.

The tongues 22 also limit twisting of the inner post 3 relative to the outer post 5 when a play net 23 is attached to the inner post 3 and passed through the net passage 7. The cross-sectional shape of the hollow box section of the outer post 5 and the guide region 20, 21 of the inner post 3 could therefore also be circular without affecting the function.

Below the lower guide region 21, the inner post 3 has a spindle 12 with a thread. The length of the spindle 12 can be, for example, between 4.5 cm and 6.5 cm, in particular about 5.5 cm. At the upper end, the inner post 3 has a slot-shaped guide 13 for a tensioning cord 25 of the play net 23, which is aligned parallel or substantially parallel to the cross bar 6. On a rear side of the outer post 5 opposite the net passage 7, a fork 14 may be provided to allow a ball chain 26 attached to the tensioning cord 25 to be hooked in order to tighten the play net 23. The rear side of the outer post 5 may further be provided with a notch 15 extending in the longitudinal direction of the outer post 5 for guiding the tensioning cord 25 and/or the ball chain 26.

Figure 6:
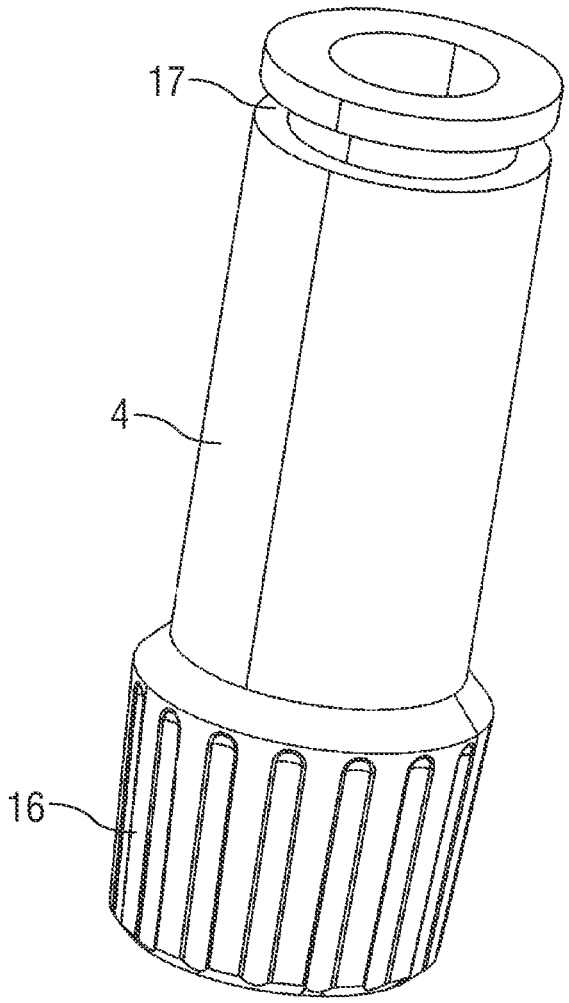
FIG. 6 is a schematic view of an adjuster of the net holder.

FIG. 6 is a schematic view of the adjuster 4.

The adjuster 4 is formed as a sleeve with an internal thread configured to engage with the thread of the spindle 12. At a lower end, the adjuster 4 may be closed. Further, an area having a knurl 16 may be provided at the lower end of the adjuster 4 to facilitate actuation of the adjuster 4. Further, this area may have an increased diameter for this purpose compared to the rest of the sleeve.

Near an upper end of the adjuster 4, the sleeve has a circumferential groove 17 configured to engage with a projection 18 disposed in the region of the lower end of the outer post 5. This way, the adjuster 4 is fixed in its position in the longitudinal direction of the outer post 5, but can rotate freely. In particular, a length of the adjuster 4 is selected in relation to the body 2 such that the lower end of the adjuster 4, in particular the knurl 16, protrudes from the bottom of the body 2 and can thus be easily actuated. The length of the adjuster 4 may be, for example, between 4.5 cm and 6.5 cm, in particular about 5.5 cm. The projection 18 can be formed in the connecting region 11 as a rib running around in the shape of an arc of a circle, in particular at most in the shape of a semicircle, in particular on the inside on the rear side of the outer post 5.

By turning the adjuster 4, the inner post 3 is adjusted in height relative to the outer post 5. In this way, the height of a play net 23 attached to the inner post 3 can be adjusted.

To assemble the net holder 1 with a play net 23, the adjuster 4 is first inserted in the longitudinal direction of the outer post 5 through the downwardly open hollow box profile of the cross bar 6 in the connecting region 11, for example until the adjuster 4 abuts against an upper wall of the cross bar 6. In this position, the groove 17 is aligned in the longitudinal direction of the outer post 5 with the projection 18 and can be engaged therewith by sliding it in a direction away from the wall 9. Below the projection 18, a radial stop (not shown) may be provided internally at the rear of the outer post 5 in the connection region 11 to support the adjuster 4.

The inner post 3 is inserted, spindle 12 first, into the net loop 24 of the play net 23 until the net loop 24 lies between the upper and lower guide region 20, 21, the tongues 22 being guided over the net loop 24.

Figure 7:
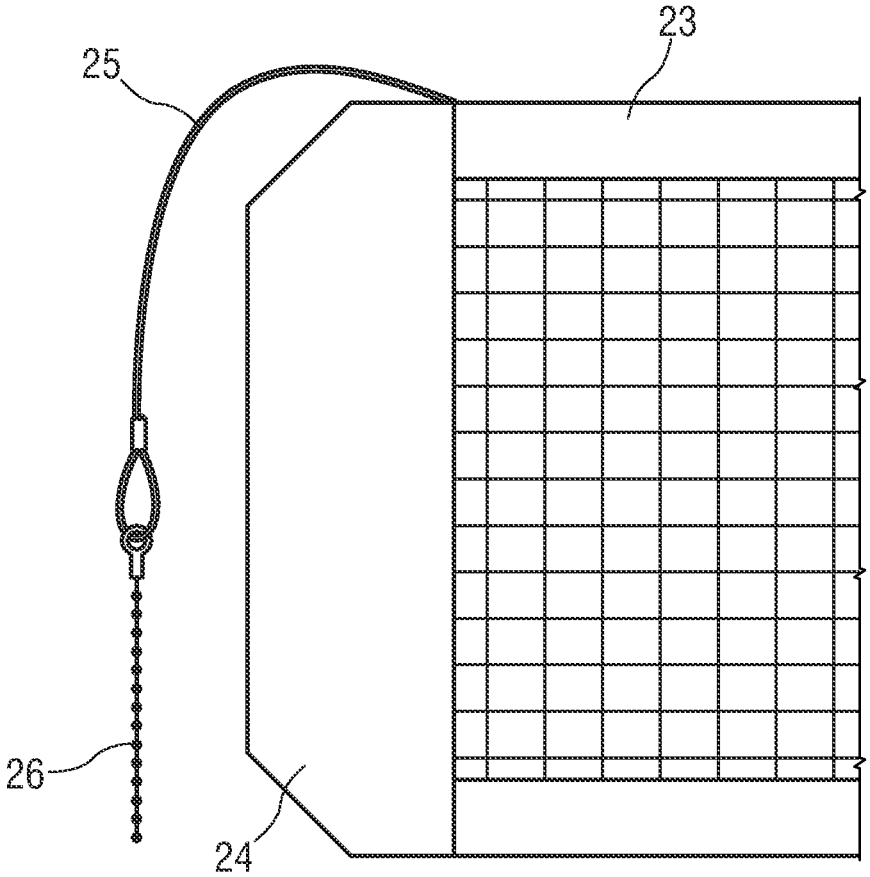
FIG. 7 is a schematic view of a play net.
Figure 8:
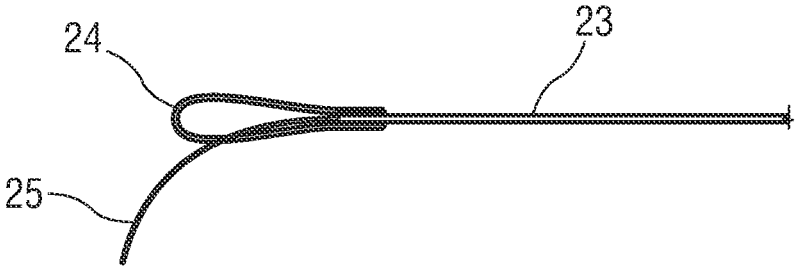
FIG. 8 is a further schematic view of the play net.

FIGS. 7 and 8 are schematic views of the play net 23 with the net loop 24, the tensioning cord 25 and the ball chain 26.

The inner post 3 with the play net 23 is now inserted from above into the outer post 5 with the spindle 12 leading, whereby the play net 23 is guided through the net passage 7. As soon as the spindle 12 reaches the adjuster 4, the latter is rotated to engage the spindle 12 with the internal thread in the adjuster 4. Once engaged, the adjuster 4 is fixed coaxially with the spindle 12. Since the spindle 12 is fixed in position in the outer post 5 by the complementary shapes of the guide region 20, 21 and the outer post 5, the groove 17 of the adjuster 4 cannot radially disengage from the projection 18 once the spindle 12 is engaged with the internal thread in the adjuster 4. Thus, by rotating the adjuster 4, the position of the inner post 3 longitudinally relative to the outer post 5, and thus the net height above the playing table, can be adjusted.

Subsequently, the tensioning cord 25 of the play net 23 can be pulled over the guide 13 and down the back of the outer post 5. A ball chain 26 attached to the tensioning cord 25 can be hooked into the fork 14 to tighten the play net 23.

LIST OF REFERENCES

1 net holder
2 body
3 inner post
4 adjuster
5 outer post
6 cross bar
7 net passage
8 stiffening rib
9 wall
10 attachment opening
11 connecting region
12 spindle
13 guide
14 fork
15 notch
16 knurl
17 groove
18 projection
19 net mounting portion
20 upper guide region
21 lower guide region
22 tongue
23 play net
24 net loop
25 tensioning cord
26 ball chain

What is claimed is:

1. A net holder for a play net, comprising:

an inner post with a net mounting portion designed for insertion into a net loop of the play net, and a spindle with an external thread, an at least substantially L-shaped body with an outer post and a cross bar, the outer post being designed as a hollow box profile for receiving and guiding the inner post and having a slot-shaped net passage, the cross bar having at a free end a fastener for fastening to a playing table, and an adjuster formed as a sleeve having an internal thread configured for engagement with the external thread of the spindle, wherein a retainer is provided for retaining the adjuster with respect to a longitudinal position relative to the outer post but allowing rotation of the adjuster, wherein at least one of the inner post and the outer post comprises a limiter for limiting a rotation of the inner post in the outer post, which however allows a longitudinal displacement.

2. The net holder according to claim 1, wherein the cross bar is formed integrally with the outer post.

3. The net holder according to claim 1, wherein said retainer comprises a circumferential groove in an outer surface of said adjuster and a projection arranged in said body configured to engage said groove.

4. The net holder according to claim 1, wherein said limiter comprises complementary non-circular cross-sections of said outer post and said inner post.

5. The net holder according to claim 1, wherein said limiter comprises at least one tongue extending on said inner post in the longitudinal direction thereof and configured to engage over a net loop disposed on said net mounting portion.

6. The net holder according to claim 1, wherein the adjuster has a length such that it protrudes from the body when the retainer is engaged.

7. The net holder according to claim 3, wherein the adjuster is fixed coaxially with the spindle by engaging the spindle with the thread of the adjuster in the outer post, thus preventing the groove from disengaging from the projection in a radial direction.

8. The net holder according to claim 1, wherein the inner post has at its end remote from the spindle a slot-shaped guide for a tensioning cord of the play net.

9. The net holder according to claim 8, wherein a fork is provided on a rear side of the outer post opposite the net passage, which fork enables a ball chain attached to the tensioning cord to be hooked in.

10. A net set comprising one or two net holders according to claim 1 and a play net provided at one or two ends with a net loop configured to wrap around the net mounting portion, wherein the net passage is configured to allow the play net to pass therethrough.

11. The net set according to claim 10, wherein the play net comprises a tensioning cord having two ends, at least one of which is connected to a ball chain configured to be hooked into the fork.

* * * * *